US006034625A

United States Patent [19]

Mitsuno

[11] Patent Number: 6,034,625

[45] Date of Patent: Mar. 7, 2000

[54] RADIO-COMMUNICATION VEHICLE IDENTIFICATION SYSTEM

[75] Inventor: Atsushi Mitsuno, Tokyo, Japan

[73] Assignee: NEC Corporation, Tokyo, Japan

[21] Appl. No.: 09/173,689

[22] Filed: Oct. 16, 1998

[30] Foreign Application Priority Data

Oct. 17, 1997 [JP] Japan ..... 9-285408

[51] Int. Cl.[7] ..... G08G 1/017

[52] U.S. Cl. ..... 340/937; 340/933; 340/539; 342/44

[58] Field of Search ..... 340/933, 539, 340/928, 937, 825.31, 825.34, 825.3, 825.69; 455/54.1, 54.2, 33.1; 342/44, 50

[56] References Cited

U.S. PATENT DOCUMENTS 5,640,156 6/1997 Okuda et al. ..... 340/928

FOREIGN PATENT DOCUMENTS 1-107000 7/1989 Japan .
6-89381 3/1994 Japan .
8-202983 8/1996 Japan .
8-202984 8/1996 Japan .

OTHER PUBLICATIONS

"Direction Finding Technology and Application to Radio–communication Vehicle Identification System" by Atsushi Mitsuno et al., NEC Technical Jounal, vol. 50, No. 7, Jul. 25, 1997, pp. 147–155.

"Application of Directional Finder to the Electronic Toll Collection System" by Yoshihiko Kuwahara et al., Technical Report of the Institute of Electronics Information and Communication Engineers, vol. 97, No. 55, May 22, 1997, pp41–48.

*Primary Examiner*—Daryl Pope
*Attorney, Agent, or Firm*—McGinn & Gibb, P.C.

[57] ABSTRACT

A radio-communication vehicle identification apparatus includes first and second radio communication units, a directional finding unit, a vehicle classification unit, and a vehicle identification unit. The first radio communication unit is mounted on a vehicle. The second radio communication unit is placed at a gate through which the vehicle passes to perform radio communication with the first radio communication unit. The directional finding unit measures an arrival angle of a radio signal transmitted from the first radio communication unit with respect to a reference direction. The vehicle classification unit detects a length of the vehicle on the basis of image data obtained by photographing the vehicle and classifies the vehicle on the basis of a detection result. When the vehicle has reached a predetermined position on the gate, the vehicle identification unit determines whether the arrival angle output from the directional finding unit falls within an arrival angle range of the radio signal from the first radio communication unit, which corresponds to vehicle classification data output from the vehicle classification unit, and identifies the vehicle having the first radio communication unit on the basis of a determination result.

19 Claims, 13 Drawing Sheets

FRAME SYNCHRONOUS PULSE

DF SAMPLE PULSE

RADIO COMMUNICATION DATA
COMMUNICATION SLOT
DF SLOT

DF SAMPLE DATA

DF CALCULATION OUTPUT

FIG. 10A
FIG. 10B
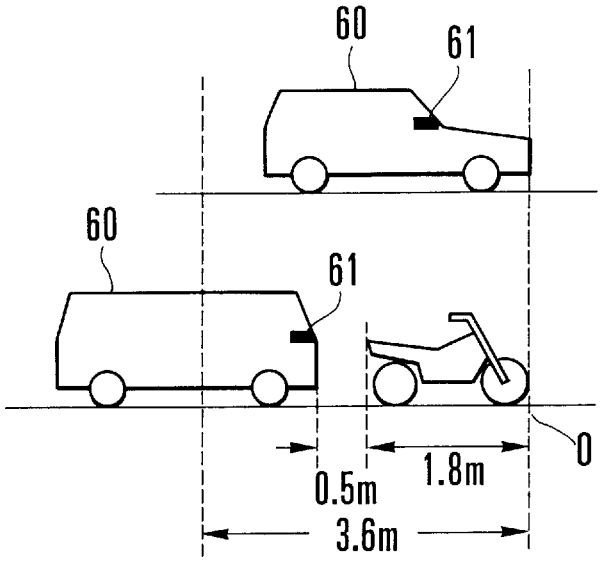
FIG. 10C
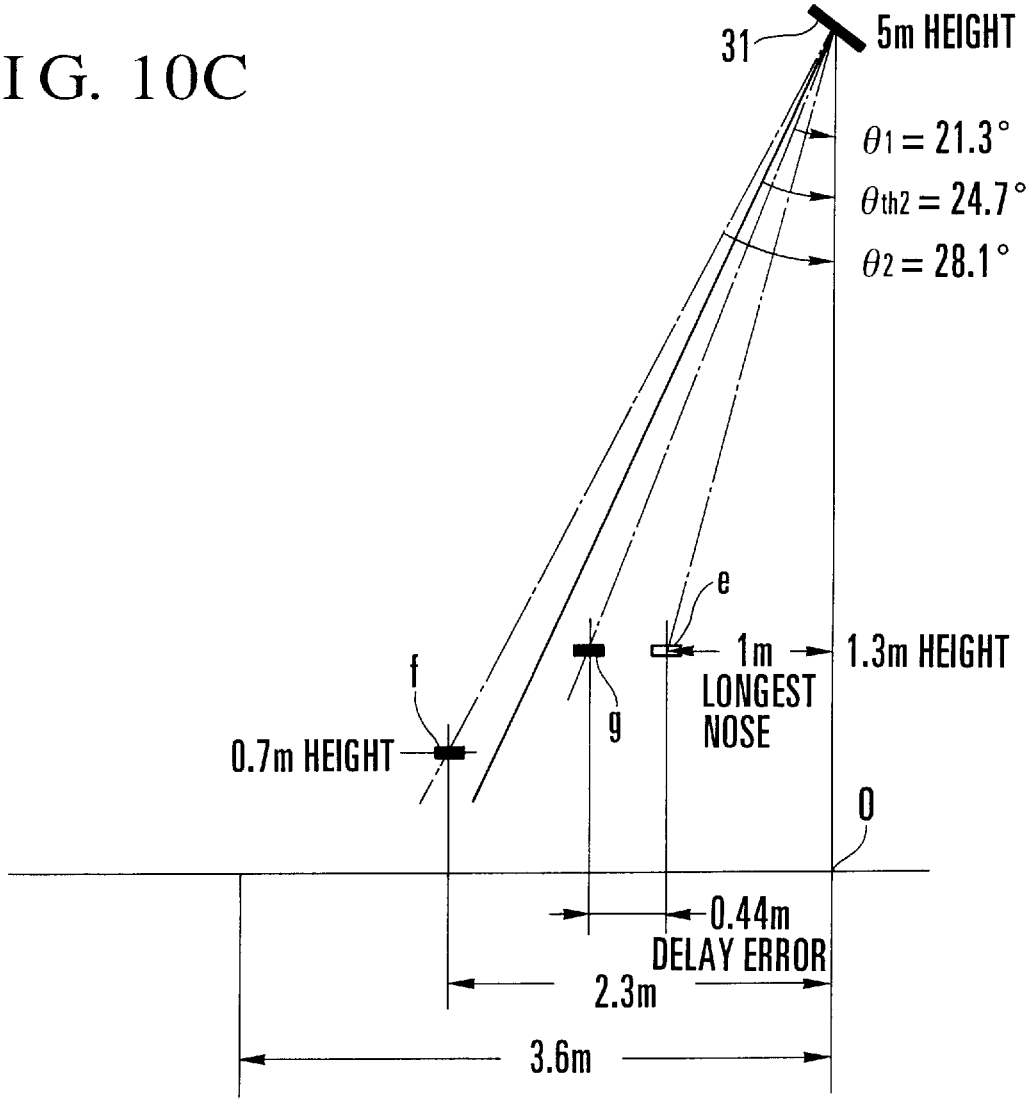

| No. | VEHICLE ID | COMMUNICATION ESTABLISHMENT TIME | FRAME NUMBER | SLOT NUMBER | ARRIVAL ANGLE |
|---|---|---|---|---|---|
| 1 | × × × × | ○ ○ ○ ○ | + + + | △ △ △ | * *.* * ° |
| 2 | | | | | |
| 3 | | | | | |
| 4 | | | | | |

FIG. 13

RADIO-COMMUNICATION VEHICLE IDENTIFICATION SYSTEM

BACKGROUND OF THE INVENTION

The present invention relates to a vehicle radio communication system for performing radio communication between a vehicle and a structure through which the vehicle passes to identify the vehicle and, more particularly, to a vehicle identification system using radio wave arrival angle measurement for specifying a vehicle on the basis of the arrival angle of a radio wave transmitted from the vehicle.

As one of radio communication systems, there is an ETC (Electronic Toll Collection) system which charges vehicles for use of a toll road by radio communication. The ETC system is constituted by a first radio communication unit and electronic payment means (e.g., an IC card) mounted on a vehicle, and a second radio communication unit set at the toll gate (gate) of a toll road to communicate with the first radio communication unit.

In such an ETC system, the toll of the toll road is collected upon radio communication from the gate to the vehicle when the vehicle passes through the gate. More specifically, the toll is paid from the electronic payment means of the vehicle upon charging processing by radio communication from the gate.

Vehicles passing through the gate include vehicles compatible with ETC (to be referred to as ETC vehicles hereinafter) and vehicles incompatible with ETC (to be referred to as non-ETC vehicles hereinafter). When a lane dedicated to ETC vehicles or a lane for both ETC and non-ETC vehicles is set at the gate, the operator at the gate can collect the toll without contacting the drivers of the ETC vehicles.

According to this ETC system, the toll of the toll road can be collected without stopping vehicles at the gate. With this system, economical loss due to traffic delay can be avoided, convenience for users can be improved, and the labor in charging operation can be decreased.

The above-described conventional ETC system will be described with reference to FIGS. 14 and 15.

Referring to FIGS. 14 and 15, when an ETC vehicle 142 enters a communication setting area A of a radio communication antenna 121, which is set at the gate, communication for ETC (to be referred to as ETC communication hereinafter) is established between the radio communication unit at the gate and a radio communication unit 141 of the ETC vehicle 142.

However, when a non-ETC vehicle (not shown) enters a lane dedicated for the ETC vehicles 142 or a lane for both ETC vehicles and non-ETC vehicles, communication with the non-ETC vehicle is not performed. In this case, "stop" is turned on at an indicator 105 to stop the non-ETC vehicle.

If the gate is at the entrance of the toll road, a ticketing machine 151 issues a ticket. If the gate is at the exit of the toll road, the clerk in a tollbooth 152 collects the toll. For a vehicle in violation of the stop instruction, the number or driver of the vehicle is photographed, and the driver is charged later.

The communication setting area A where communication for ETC is done is set in the range of several meters in front of the radio communication antenna 121 so that a plurality of vehicles are hardly simultaneously present in the area. However, since the communication channel is designed in consideration of the system margin, and limitations are imposed on beam shaping by the radio communication antenna 121, communication is sometimes established even outside the communication setting area A. The area where ETC communication is established will be referred to as a communication enabled area B.

The communication enabled area B is wider than the communication setting area A, and a plurality of vehicles can easily simultaneously enter the communication enabled area B. As shown in FIGS. 14 and 15, the ETC vehicle 142 following a non-ETC vehicle 144 may enter the gate, and the non-ETC vehicle 144 and the ETC vehicle 142 may simultaneously present in the communication enabled area B.

In this case, ETC communication is established not with the preceding non-ETC vehicle 144 but with the ETC vehicle 142 following the non-ETC vehicle 144. However, since the vehicle which has transmitted the ETC communication signal cannot be specified, the gate side misunderstands that the ETC procedure with the non-ETC vehicle 144 is ended and allows the non-ETC vehicle 144 to pass. In fact, the non-ETC vehicle 144 is not charged, so reliable toll collection processing cannot be performed.

SUMMARY OF THE INVENTION

It is an object of the present invention to provide a vehicle identification apparatus and method capable of specifying an ETC vehicle in a plurality of vehicles passing through a gate.

In order to achieve the above object, according to the present invention, there is provided a radio-communication vehicle identification apparatus comprising first radio communication means mounted on a vehicle, second radio communication means placed at a gate through which the vehicle passes to perform radio communication with the first radio communication means, directional finding means for measuring an arrival angle of a radio signal transmitted from the first radio communication means with respect to a reference direction, vehicle classification means for detecting a length of the vehicle on the basis of image data obtained by photographing the vehicle and classifying the vehicle on the basis of a detection result, and vehicle identification means for, when the vehicle has reached a predetermined position on the gate, determining whether the arrival angle output from the directional finding means falls within an arrival angle range of the radio signal from the first radio communication means, which corresponds to vehicle classification data output from the vehicle classification means, and identifying the vehicle having the first radio communication means on the basis of a determination result.

BRIEF DESCRIPTION OF THE DRAWINGS

FIGS. 10A to 10C are views for explaining a method of setting the reference angle for a short vehicle;

FIG. 13 is a view showing an example of a DF table shown in FIG. 12;

DESCRIPTION OF THE PREFERRED EMBODIMENT

The present invention will be described below in detail with reference to the accompanying drawings.

Figure 1:
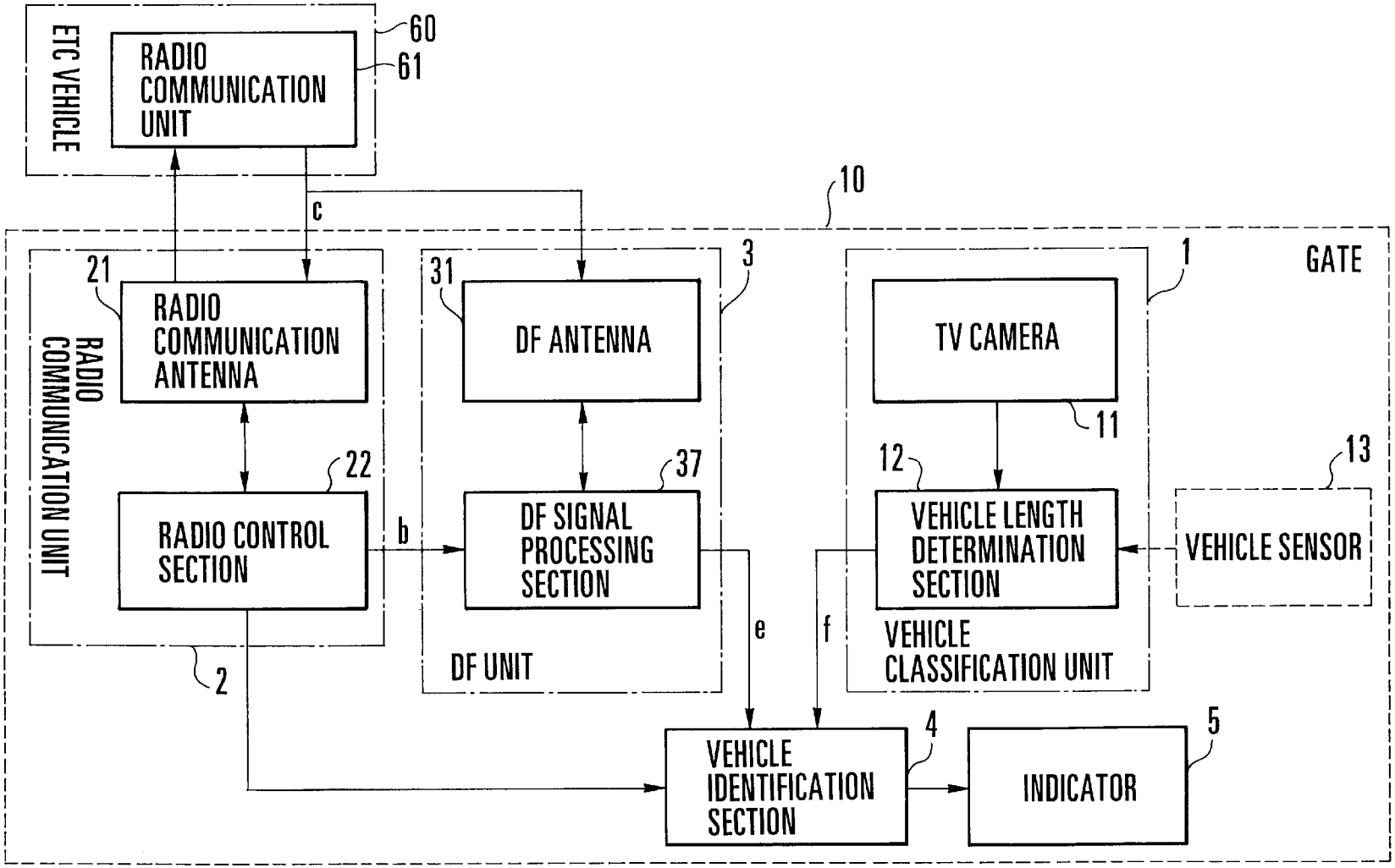
FIG. 1 is a block diagram showing the arrangement of an ETC system according to an embodiment of the present invention.

FIG. 1 shows the arrangement of an ETC system according to an embodiment of the present invention. An ETC system applied to the gate of a toll road will be described.

Referring to FIG. 1, the ETC system of this embodiment comprises a gate 10 having a vehicle classification unit 1 for classifying approaching (passing) vehicles one by one on the basis of photographed images, a radio communication unit 2 for performing ETC communication using a radio signal, a DF (Directional Finding) unit 3 for detecting the direction of the radio signal, a vehicle identification section 4 for specifying each approaching vehicle on the basis of the outputs from the radio communication unit 2 and the DF unit 3, and an indicator 5 for giving an instruction to each approaching vehicle, and an ETC vehicle 60 on which a radio communication unit for performing ETC communication with the radio communication unit 2 is mounted.

The vehicle classification unit 1 has a TV camera 11 as an image sensing means for photographing each approaching vehicle, and a vehicle length determination section 12 for determining the length of an approaching vehicle on the basis of image data output from the TV camera 11. The radio communication unit 2 has a radio communication antenna 21 for transmitting/receiving a radio signal to/from a radio communication unit 61 of the ETC vehicle 60, and a radio control section 22 for controlling radio communication through the antenna 21.

The DF unit 3 has a DF antenna 31 for receiving the radio signal from the radio communication unit 61 of the ETC vehicle 60, and a DF signal processing section 37 for processing a DF signal output from the DF antenna 31.

Figure 12:
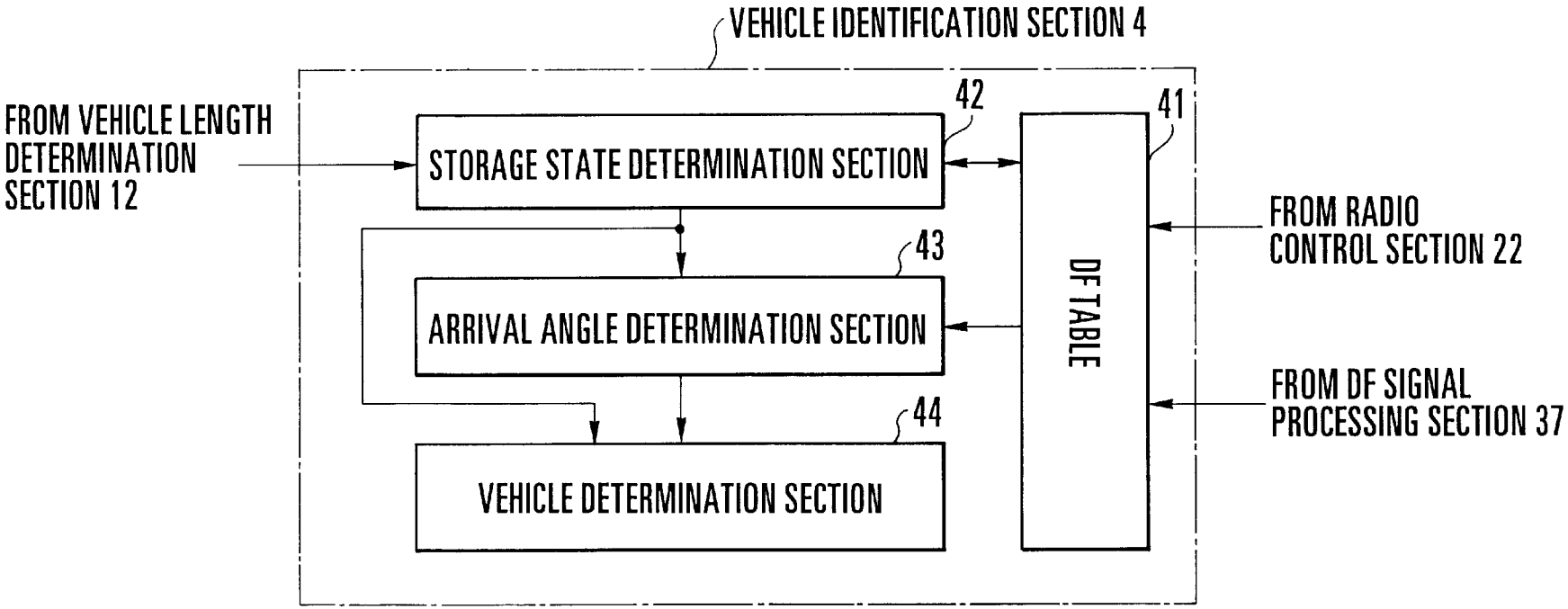
FIG. 12 is a block diagram showing the arrangement of the vehicle identification section shown in FIG. 1.
Figure 14:
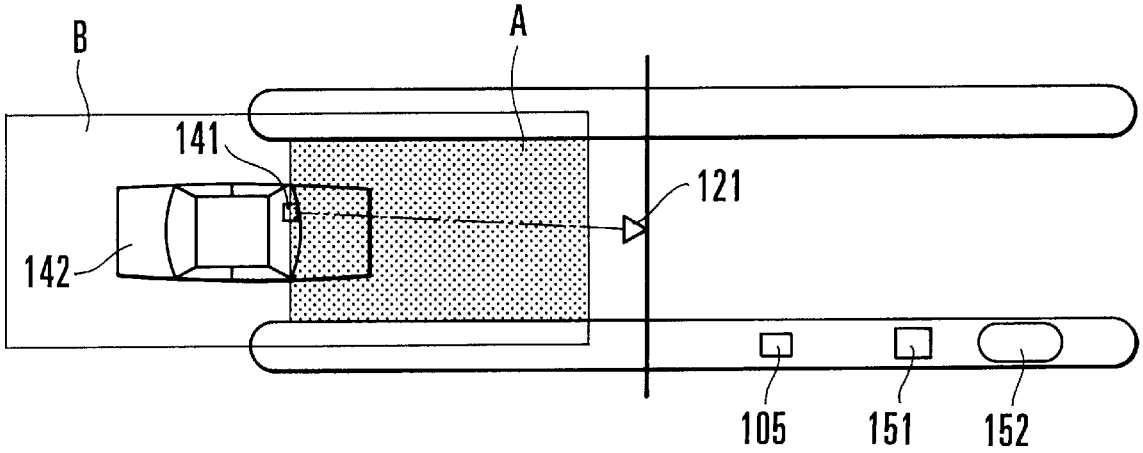
FIG. 14 PRIOR ART
FIG. 14 is a plan view schematically showing the gate portion of a conventional ETC system.
Figure 15:
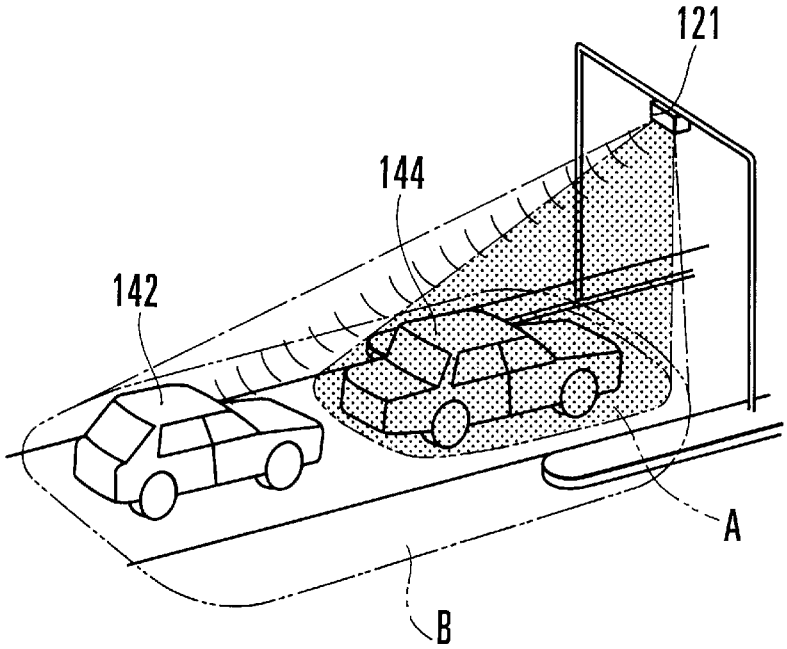
FIG. 15 PRIOR ART
FIG. 15 is a perspective view of the gate portion of the ETC system shown in FIG. 14.

As shown in FIG. 12, the vehicle identification section 4 comprises a DF table 41 prepared on the basis of data from the radio control section 22 and the DF signal processing section 37, a storage state determination section 42 for, when the determination result is output from the vehicle length determination section 12, determining whether the arrival angle of the radio wave is stored in the DF table 41, an arrival angle determination section 43 for, when the storage state determination section 42 determines that the arrival angle is stored in the DF table 41, determining whether the arrival angle of the radio signal falls within a predetermined angle range according to the determination result from the vehicle length determination section 12, and a vehicle determination section 44 for determining whether the object is the ETC vehicle 60 on the basis of the outputs from the storage state determination section 42 and the arrival angle determination section 43.

FIG. 13 shows an example of the DF table 41 shown in FIG. 12. In the DF table 41, the vehicle ID, communication establishment time, frame number, and slot number output from the radio control section 22, and the radio wave arrival angle output from the DF signal processing section 37 are updated and stored.

As shown in FIG. 1, the output side of the TV camera 11 is connected to the vehicle length determination section 12. The radio communication antenna 21 is connected to the radio control section 22. The DF antenna 31 is connected to the DF signal processing section 37. The output side of the radio control section 22 is connected to the input side of the DF signal processing section 37. The output sides of the vehicle length determination section 12, the radio control section 22, and the DF signal processing section 37 are connected to the vehicle identification section. The indicator 5 is connected to the output side of the vehicle identification section 4.

Figure 2:
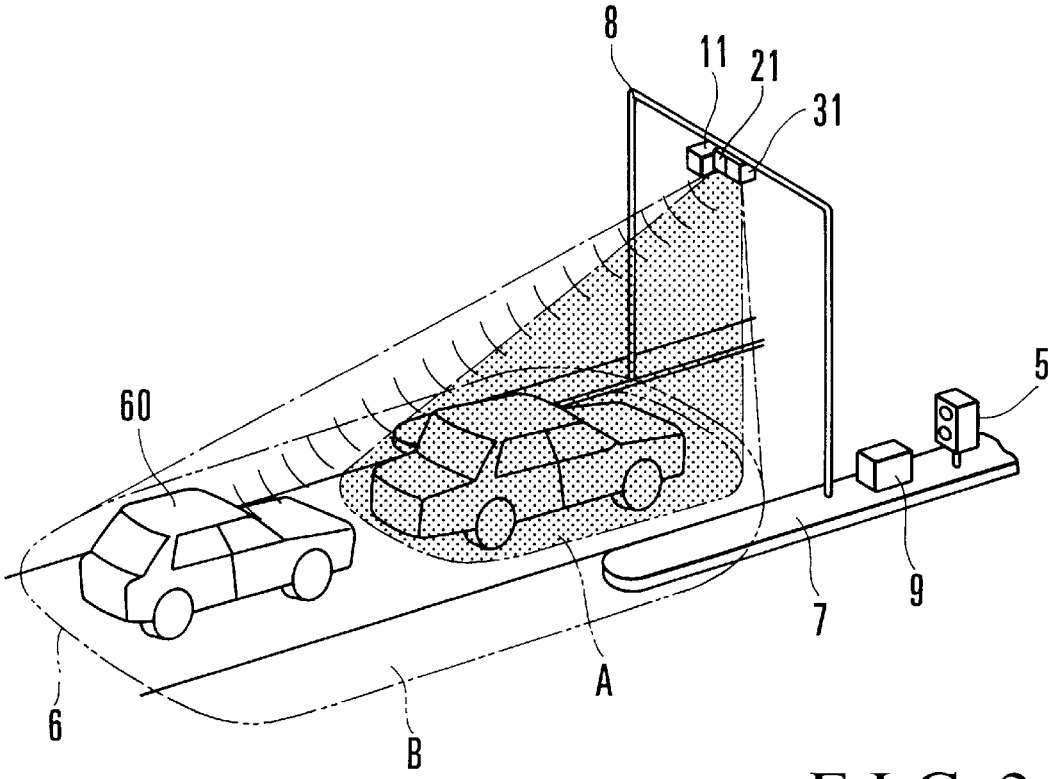
FIG. 2 is a perspective view of the gate portion of the ETC system shown in FIG. 1.

FIG. 2 shows the gate portion in FIG. 1. As shown in FIG. 2, an arch 8 is placed across an ETC lane 6. The radio communication antenna 21 and the DF antenna 31 attached side by side to the arch 8 almost immediately above the ETC lane 6.

The TV camera 11 is set on a shoulder 7 near a communication setting area A of the radio communication antenna 21. A box 9 which accommodates the vehicle length determination section 12, the radio control section 22, the DF signal processing section 37, and the vehicle identification section 4, and the indicator 5 are also set on the shoulder 7.

The radio communication unit 61 is mounted on the dashboard of the ETC vehicle 60 entering the ETC lane 6.

Figure 3:
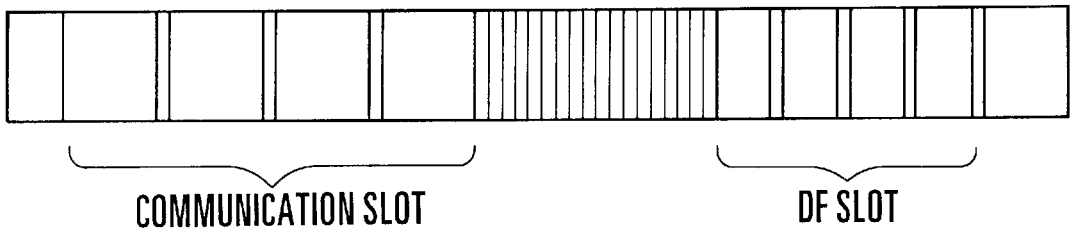
FIG. 3 is a view showing the frame format of a radio signal transferred between an ETC vehicle and the gate shown in FIG. 1.

FIG. 3 shows the frame format of a radio signal to be transferred between the radio communication units 2 and 61 for ETC communication. In correspondence with the communication slot shown in FIG. 3, the radio control section 22 performs ETC communication with the radio communication unit 61 in a communication enabled area B in accordance with a predetermined communication protocol. In correspondence with the DF slot shown in FIG. 3, the radio control section 22 instructs the DF signal processing section 37 to sample the radio signal transmitted from the radio communication unit 61.

The radio control section 22 assigns, to the radio communication unit 61 in the communication enabled area B, time at which ETC communication is to be performed and time at which the DF radio signal is to be transmitted. With this arrangement, even when a plurality of ETC vehicles 60 are simultaneously present in the communication enabled area B, the radio control section 22 can time-divisionally perform ETC processing and DF processing for every radio communication unit 61.

Each of the communication slot and the DF slot shown in FIG. 3 has four slots, so the radio control section 22 can simultaneously communicate with four ETC vehicles 60 in the communication enabled area B. The number of slots constituting the communication slot or DF slot corresponds to the maximum number of vehicles capable of simultaneously running through the communication enabled area B.

In FIG. 1, the DF antenna 31 receives the DF radio signal transmitted from the radio communication unit 61 and supplies the radio signal to the DF signal processing section 37. Since the DF antenna 31 is set next to the radio communication antenna 21, the effective measurement range of the DF unit 3 can be almost matched with the communication enabled area B of the radio communication unit 2.

The DF signal processing section 37 processes the radio signal received by the DF antenna 31 to measure the radio wave arrival angle. The radio wave arrival angle means the angle made by the radio wave reception direction and the vertical direction.

The DF signal processing section 37 operates on the basis of the principle of an interferometer for estimating the arrival direction from the phase difference between signals received by a 2-element array antenna.

This will be described in detail. Assume that a radio wave having a wavelength $\lambda$ is incident on a 2-element array antenna with an element interval d at an angle $\theta$ with respect to the vertical direction. A phase difference $\Delta\Phi$ between received signals XM and XN (the received signals XM and XN are complex signals) received by reception elements M and N of the 2-element array antenna is given by:

$$\Delta\phi = XM\ XN^{*}/|XM\ XN| \quad (1)$$

$$= \exp\{2\pi d\sin(\theta/\lambda)\}$$

where * represents complex conjugate. When the phase difference $\Delta\Phi$ is obtained from the received signals XM and XN, the radio wave arrival angle $\theta$ can be calculated from equation (1).

When the front end of the vehicle running on the ETC lane 6 has reached a predetermined position, the vehicle identification section 4 determines on the basis of the arrival angle of the radio wave whether the radio signal is transmitted from the vehicle at the predetermined position.

As described above, the radio communication unit 61 is mounted on the dashboard of the ETC vehicle 60. The vehicle shape and the length from the front end of the vehicle to the dashboard change depending on the type of vehicle. For this reason, although the setting position of the radio communication unit 61 of each ETC vehicle 60 cannot be specified, the setting position of the radio communication unit 61 can be estimated.

When the DF radio wave is transmitted from the estimated setting range of the radio communication unit 61 which has been set in advance, the vehicle identification section 4 determines that the radio wave is transmitted from the ETC vehicle 60 reaching the predetermined position.

The "predetermined position" is a position where the estimated setting range of the radio communication unit 61 can be estimated. In this case, the "predetermined position" is set at the DF angle origin (immediately under the DF antenna 31). It is determined whether the vehicle is the ETC vehicle 60, on the basis of the arrival angle of the radio wave when the front end of the vehicle passing on the ETC lane 6 has reached the DF angle origin.

Figure 4A:
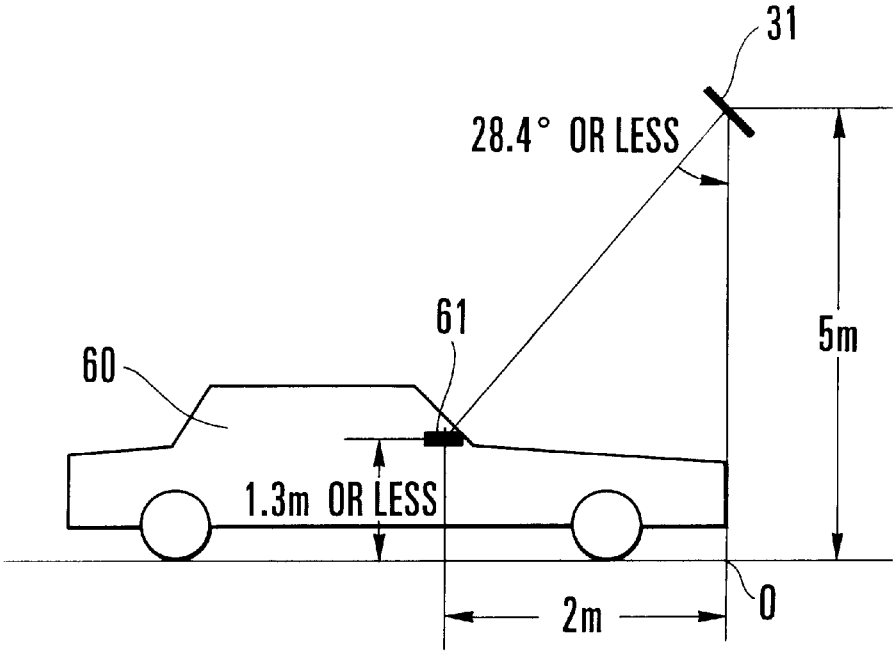
FIGS. 4A and 4B are views showing the arrival angle of a radio signal.
Figure 4B:
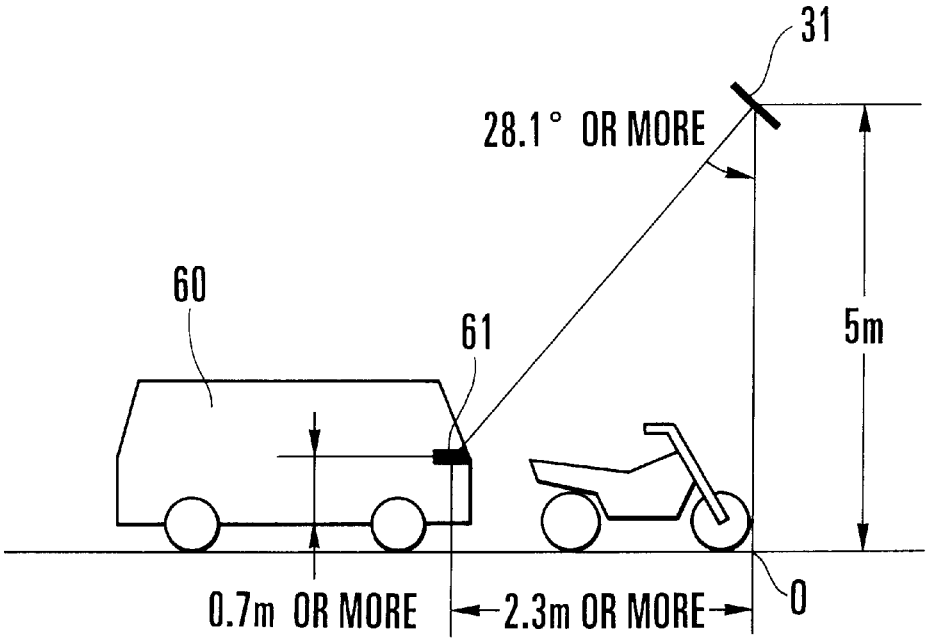

FIGS. 4A and 4B explain the arrival angle of the radio wave. The DF antenna 31 is set at a position 5 m above the ground.

In FIG. 4A, the ETC vehicle 60 with a long nose passes on the ETC lane 6. As shown in FIG. 4A, when it is assumed that the height of the dashboard of the ETC vehicle 60 with a nose of 2 m is 1.3 m or less, the radio communication unit 61 mounted on this ETC vehicle 60 is separated from the front end of the vehicle by 2 m and from the ground by 1.3 m or less. In this case, when the front end of the ETC vehicle 60 reaches a DF angle origin O, the arrival angle of the radio wave transmitted from the radio communication unit 61 is 28.4° or less.

In FIG. 4B, a one-box car (noseless car) as the ETC vehicle 60 passes on the ETC lane 6 next to a motorcycle as a non-ETC vehicle. Referring to FIG. 4B, assume that the length of the motorcycle is 1.8 m or more, the height of the dashboard of the one-box car is 0.7 m or more, and the distance between the ETC vehicle ahead and the subsequent ETC vehicle 60 is 0.5 m. The radio communication unit 61 mounted on the ETC vehicle 60 is located at a position separated from the front end of the non-ETC vehicle by 2.3 m or more and from the ground by 0.7 m or more. In this case, when the front end of the non-ETC vehicle ahead reaches the DF angle origin O, the arrival angle of the radio wave transmitted from the radio communication unit 61 mounted on the subsequent ETC vehicle 60 is 28.1° or more.

Since the arrival angles of the radio waves in FIGS. 4A and 4B are critical angles and almost equal each other, the ETC vehicle 60 cannot be specified only from the arrival angle of the radio wave.

To specify the ETC vehicle 60 even under the above-described condition, the long nose vehicle and the short noseless vehicle following the motorcycle must be discriminated, and the estimated setting range of the radio communication unit 61 in each ETC vehicle must be set. Since the length of the long nose vehicle is long, and a short vehicle has no (short) nose, the setting position of the radio communication unit 61 in the ETC vehicle 60 can be specified, as will be described later.

In this embodiment, the vehicle classification unit 1 shown in FIG. 1 is used to determine whether the vehicle passing through the DF angle origin O of the ETC lane 6 is a long vehicle or a short vehicle, and one of predetermined estimated setting ranges of the radio communication unit 61 is applied to the long vehicle or short vehicle in accordance with the determination result. When the DF radio wave is transmitted from the applied estimated setting range, it is determined that the radio wave is transmitted from the vehicle reaching the DF angle origin O.

Figure 5:
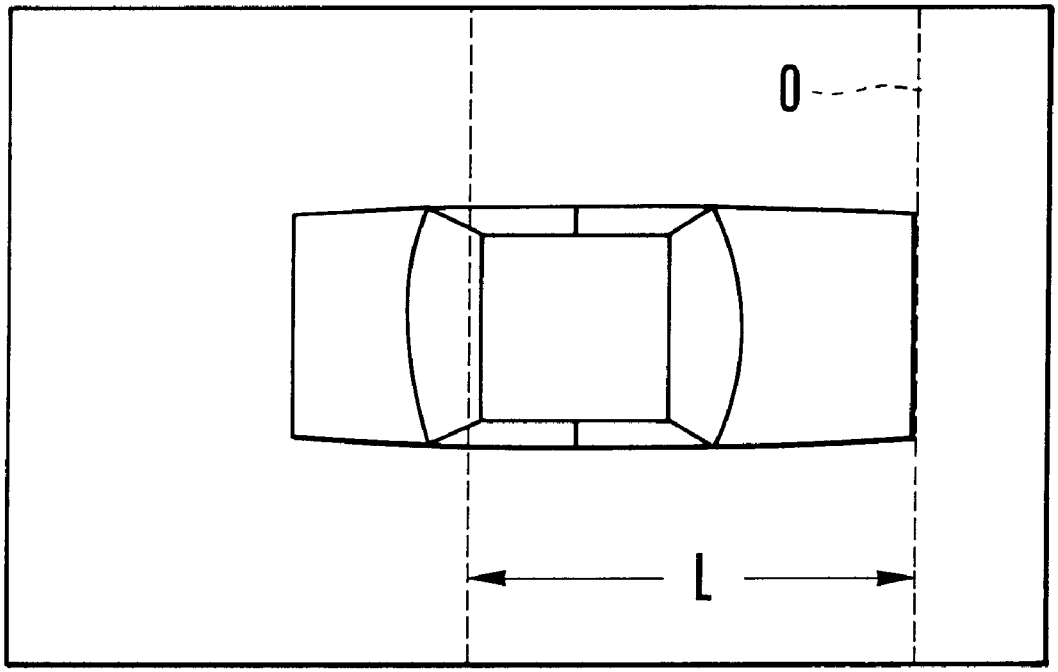
FIG. 5 is a view showing an example of the image output from a TV camera shown in FIG. 1.

The TV camera 11 of the vehicle classification unit 1 is attached to the arch 8 to photograph the upper surface of the vehicle passing on the ETC lane 6. FIG. 5 shows an example of the image output from the TV camera 11 in photographing the upper surface of the vehicle.

The vehicle length determination section 12 processes image data output from the TV camera 11 to measure the length of the vehicle. The vehicle length determination section 12 also determines whether the measured length of the vehicle is larger than a reference value L and classifies the vehicle as a long vehicle or a short vehicle on the basis of the determination result. The result is output to the vehicle identification section 4. The vehicle shown in FIG. 5 is classified as a long vehicle because the vehicle length is larger than the reference value L.

As described above, the TV camera 11 supplies image data allowing the vehicle length determination section 12 to determine the length of the vehicle. Therefore, the TV camera 11 need not always be set on the arch 8 and can be set at a position where one or both of the upper and side surfaces of the vehicle can be photographed.

As the image sensing means for supplying image data of the vehicle, the TV camera 11 is used. However, any image sensing means can be used as far as it provides image data allowing the vehicle length determination section 12 to determine the length of the vehicle. For example, the image sensing means may be a device which projects a light beam such as a laser beam in the vehicle running direction of the ETC lane 6 and senses the reflected light with a CCD camera.

When the front end of the vehicle has reached the DF angle origin O, it is determined whether the vehicle is the ETC vehicle 60. The vehicle is detected upon image processing by the vehicle classification unit 1. The vehicle classification unit 1 can independently perform detection of an approaching vehicle and determination of the length of the vehicle. In this case, however, the length of the vehicle is determined after it is detected that the vehicle has reached the DF angle origin O.

Determination may be made when the front end of the vehicle is detected using a vehicle sensor 13 (FIG. 1).

The operation of the ETC system shown in FIG. 1 will be described next with reference to FIGS. 6A to 6E.

Figures 6A, 6B, 6C, 6D, 6E:
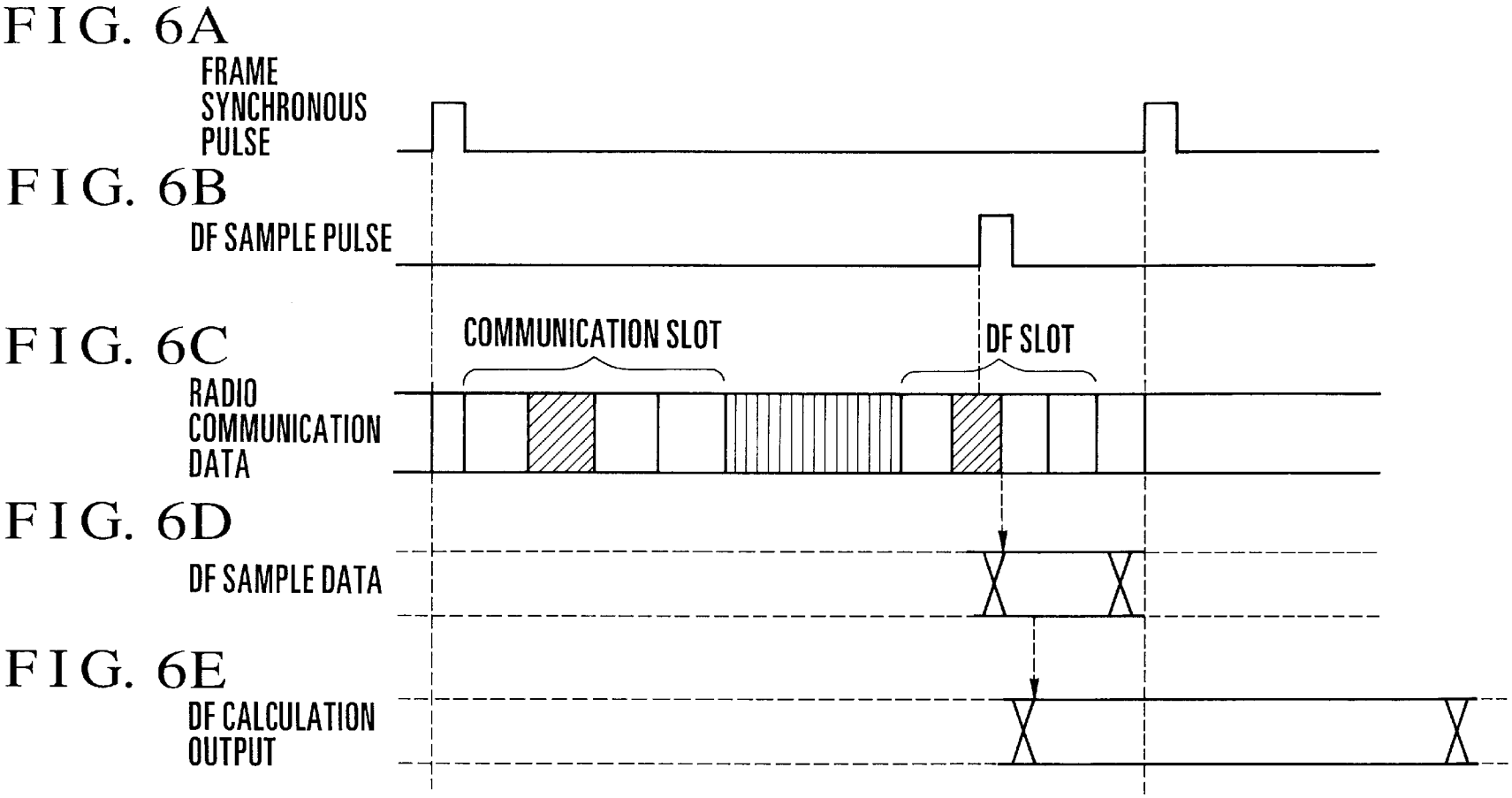
FIGS. 6A to 6E are timing charts for explaining the operations of a radio communication unit and a DF unit on the gate side shown in FIG. 1.

The radio communication unit 2 outputs a frame synchronous pulse a (FIG. 6A) at the start of each frame of radio communication data c (FIG. 6C). This frame synchronous pulse is used to, e.g., reset the slot counter for counting the slot number. When the ETC vehicle 60 enters the ETC lane 6 at the gate of the toll road and comes to the communication enabled area B of the radio communication antenna 21, the radio communication unit 61 of the ETC vehicle 60 transmits a signal to the radio communication unit 2 at the gate to request a right for ETC communication.

The signal from the ETC vehicle 60 is received by the radio communication antenna 21 and sent to the radio control section 22. The radio control section 22 registers the ETC vehicle 60 which has transmitted the signal. The radio control section 22 also assigns a communication slot for ETC communication with the radio communication unit 61 and a DF slot in which the radio communication unit 61 transmits a DF radio signal (FIG. 6C).

The radio control section 22 performs ETC communication with the radio communication unit 61 using the assigned communication slot. The radio control section 22 also outputs a DF sample pulse b to the DF signal processing section 37 in correspondence with the assigned DF slot (FIG. 6B).

The DF signal processing section 37 samples the DF slot corresponding to the radio communication data c transmitted from the radio communication unit 61 of the ETC vehicle 60 by using the DF sample pulse b to obtain DF sample data d (FIG. 6D). The DF signal processing section 37 performs DF calculation based on the principle of an interferometer for the resultant DF sample data d to obtain the arrival angle of the radio signal, and a calculation result (arrival angle) e to the vehicle identification section 4 (FIG. 6E).

Even after ETC communication is ended, the radio communication unit 61 of the ETC vehicle 60 continues to transmit the DF radio signal until the ETC vehicle 60 reaches the predetermined position P. During this time, the DF signal processing section 37 continues to measure the arrival angle e of the radio signal from the ETC vehicle 60 and output it to the vehicle identification section 4. The vehicle identification section 4 sequentially updates the arrival angle output from the DF signal processing section 37 and stores the latest arrival angle.

When the vehicle reaches the DF angle origin O, the vehicle length determination section 12 detects the approaching vehicle from image data output from the TV camera 11 and determines whether the vehicle is a long vehicle or a short vehicle.

When a signal representing the determination result is output from the vehicle length determination section 12, the vehicle identification section 4 determines whether the radio wave is transmitted from the vehicle reaching the DF angle origin O on the basis of whether the latest radio wave arrival angle stored in the DF table 41 falls within the angle range based on the estimated setting range of the radio communication unit 61, which is set in advance for a long vehicle or a short vehicle.

When it is determined that the DF radio wave is transmitted from the vehicle reaching the DF origin position 0, the vehicle identification section 4 identifies the vehicle as the ETC vehicle 60. In this case, since ETC processing is properly performed between the ETC vehicle 60 and the gate 10, "go" is turned on at the indicator 5 to allow the ETC vehicle to pass.

When the DF radio wave is not detected, or it is determined that the radio wave is transmitted from a vehicle other than the vehicle reaching the DF origin position O, the vehicle identification section 4 identifies the vehicle reaching the DF origin position O as a non-ETC vehicle. In this case, since ETC is not performed between the non-ETC vehicle and the gate 10, "stop" is turned on at the indicator 5 to stop the non-ETC vehicle, and the ticketing machine (not shown) issues a ticket or the clerk collects the toll. Alternatively, the vehicle number or driver is photographed to charge the driver later for use of the road.

When a plurality of ETC vehicles 60 continuously enter the communication enabled area B of the radio communication antenna 21, the radio control section 22 assigns different communication slots and DF slots to the ETC vehicles 60. For this reason, the radio control section 22 can time-divisionally perform ETC processing for each ETC vehicle 60. The DF signal processing section 37 can time-divisionally measure the arrival angle of the radio wave transmitted from each ETC vehicle 60. Hence, even when a plurality of ETC vehicles 60 are simultaneously present in the communication enabled area B, it can be appropriately determined whether each vehicle is the ETC vehicle 60.

Figure 7:
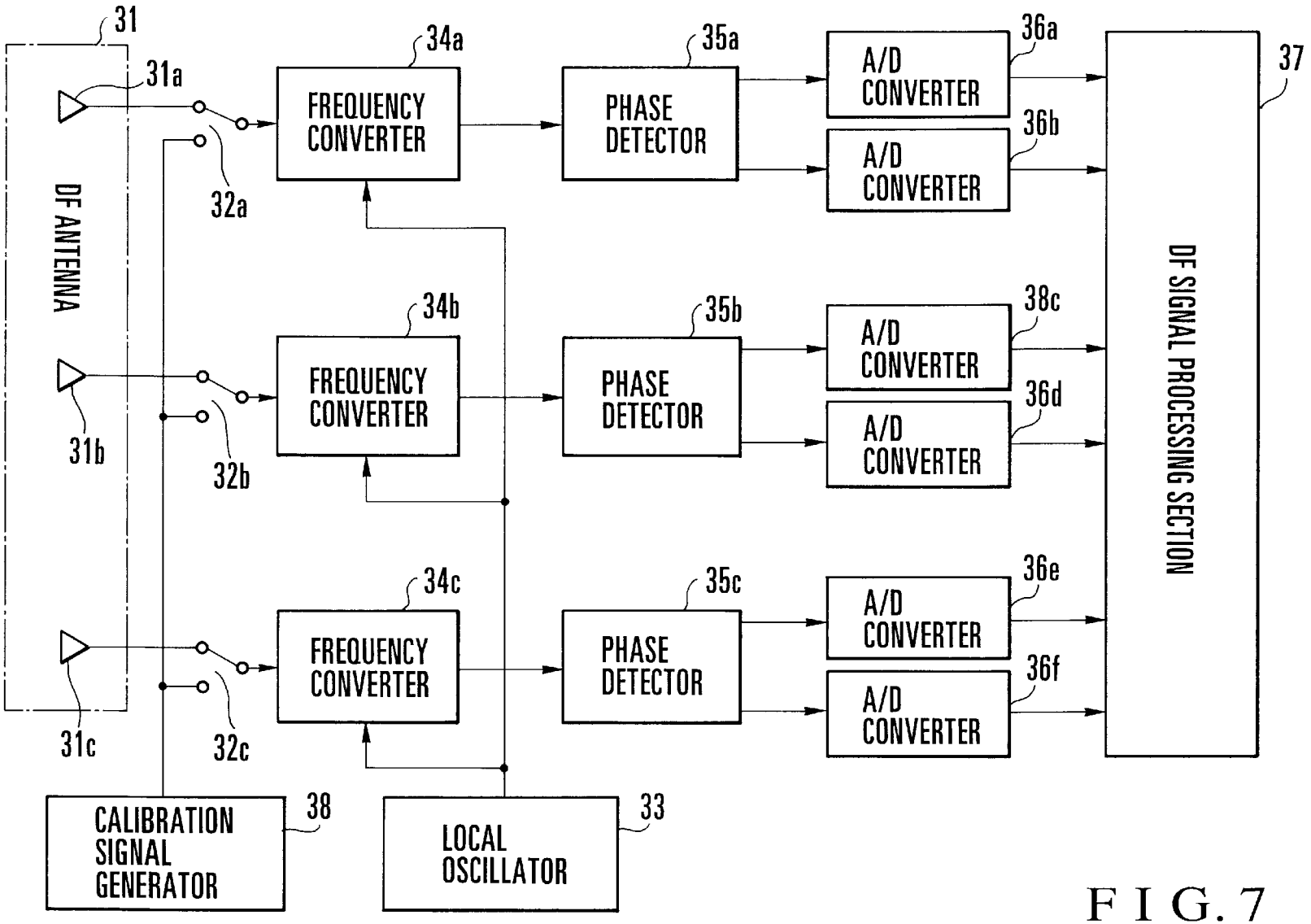
FIG. 7 is a block diagram showing the arrangement of the DF (Directional Finding) unit shown in FIG. 1.

FIG. 7 shows the arrangement of the DF unit 3. As shown in FIG. 7, the DF unit 3 comprises the DF antenna 31 (FIG. 1) having array antennas 31*a*, 31*b*, and 31*c*, change-over switches 32*a*, 32*b*, and 32*c*, a local oscillator 33, frequency converters 34*a*, 34*b*, and 34*c*, phase detectors 35*a*, 35*b*, and 35*c*, A/D (analog/digital) converters 36*a*, 36*b*, 36*c*, 36*d*, 36*e*, and 36*f*, the DF signal processing section 37 (FIG. 1), and a calibration signal generator 38.

Each of the array antennas 31*a* to 31*c* is connected to one input terminal of a corresponding one of the change-over switches 32*a* to 32*c*. The calibration signal generator 38 is connected to the other input terminal of each of the change-over switches 32*a* to 32*c*. The input side of each of the frequency converters 34*a* to 34*c* is connected to the output terminal of a corresponding one of the change-over switches 32*a* to 32*c* and the local oscillator 33. The output side of each of the frequency converters 34*a* to 34*c* is connected to a corresponding one of the phase detectors 35*a* to 35*c*.

The two output sides of the phase detector 35*a* are connected to the DF signal processing section 37 through the A/D converters 36*a* and 36*b*. The two output sides of the phase detector 35*b* are connected to the DF signal processing section 37 through the A/D converters 36*c* and 36*d*. The two output sides of the phase detector 35*c* are connected to the DF signal processing section 37 through the A/D converters 36*e* and 36*f*.

Since the DF unit 3 measures the arrival angle of the radio wave on the basis of the principle of an interferometer, each of the array antennas 31*a* to 31*c* is constituted by the two reception elements M and N (not shown). The array antennas 31*a* to 31*c* are arranged along the ETC lane 6.

The array antennas 31*a* to 31*c* receive a DF radio signal and supply the received signal to the frequency converters 34*a* to 34*c*, respectively. Each of the change-over switches 32*a* to 32*c* switches between the received signal from a corresponding one of the array antennas 31*a* to 31*c* and a calibration signal sent from the calibration signal generator 38.

The local oscillator 33 outputs a signal having a predetermined frequency to the frequency converters 34*a* to 34*c*. Each of the frequency converters 34*a* to 34*c* converts the received signal from a corresponding one of the array antennas 31*a* to 31*c* into an IF (Intermediate Frequency) signal which allows phase detection by using the output signal from the local oscillator 33. The phase detectors 35*a* to 35*c* detect the phases of the received signals which are frequency-converted by the frequency converters 34*a* to 34*c*, respectively.

The A/D converters 36*a* to 36*f* converts the received signals whose phases are detected by the phase detectors 35*a* to 35*c* into digital signals, respectively. The DF signal processing section 37 estimates the arrival angle of the received signal from the output signals from the A/D converters 36*a* to 36*f* on the basis of the principle of an interferometer.

The operation of the DF unit 3 having the above arrangement will be described next.

The DF radio signal transmitted from the radio communication unit 61 of the ETC vehicle 60 is received by the array antennas 31*a* to 31*c*. The signals received by the array antennas 31*a* to 31*c* are sent to the frequency converters 34*a* to 34*c* through the change-over switches 32*a* to 32*c*, respectively.

Each of the frequency converters 34*a* to 34*c* mixes the received signal with the signal generated by the local oscillator 33 to convert the received signal into an IF signal which allows phase detection. The phases of the received signals frequency-converted by the frequency converters 34*a* to 34*c* are detected by the phase detectors 35*a* to 35*c*, respectively, converted into digital signals by the A/D converters 36*a* to 36*f*, and sent to the DF signal processing section 37.

The received signals converted into digital signals by the A/D converters 36*a* to 36*f* are processed by the DF signal processing section 37 on the basis of the principle of an interferometer to estimate the arrival angle of the received signal in each system. To estimate the arrival angle from the signals received by the three array antennas 31*a* to 31*c*, a cost function P(θ) represented by equation (2) is introduced:

$$P(\theta) = \frac{1}{\sum_{ij}\left(\frac{X_i X_j^*}{|X_i X_j|} - \frac{R(\theta)_i R(\theta)_j^*}{|R(\theta)_i R(\theta)_j|}\right)^2} \tag{2}$$

where $R(\theta)_i$ is a reception response to the radio signal received by a reception element i (i is M and N) of each of the array antennas 31*a* to 31*c* at the angle θ.

When the phase difference ΔΦ between the received signals XM and XN received by the reception elements M and N, respectively, is calculated for reception responses RM(θ) and RN(θ) changed at a predetermined interval, the cost function P(θ) represented by equation (4) is maximized at an angle corresponding to the reception signal arrival direction. The DF signal processing section 37 can estimate the signal arrival angle by obtaining the maximum value of the cost function P(θ).

To calibrate the amplitude variation and phase variation due to the temperature of, e.g., cables connecting the array antennas 31*a* to 31*c* and the frequency converters 34*a* to 34*c*, respectively, the change-over switches 32*a* to 32*c* are switched to the calibration signal generator 38 side to calibrate the amplitude and phase of each system using the calibration signal.

In FIG. 7, the DF antenna 31 is constituted by the three array antennas 31*a* to 31*c*. However, the number of array antennas 31*a* to 31*c* of the DF antenna 31 is not limited to three.

The reference angle used to determine whether the DF radio wave is transmitted from the vehicle reaching the DF angle origin O will be described next.

Figure 8A:
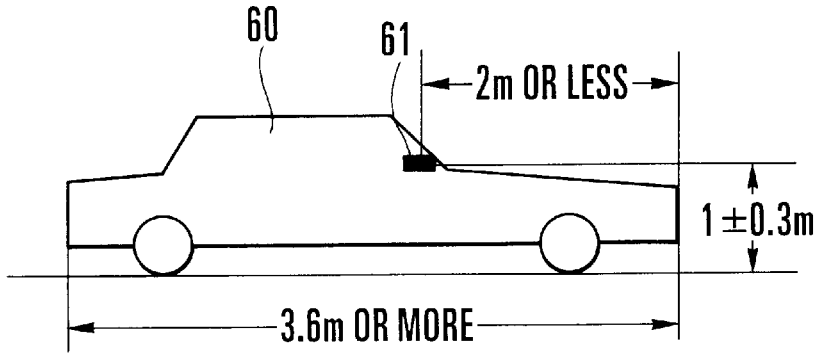
FIGS. 8A to 8C are views showing the dimensions of modeled vehicles and radio communication unit setting positions.
Figure 8B:
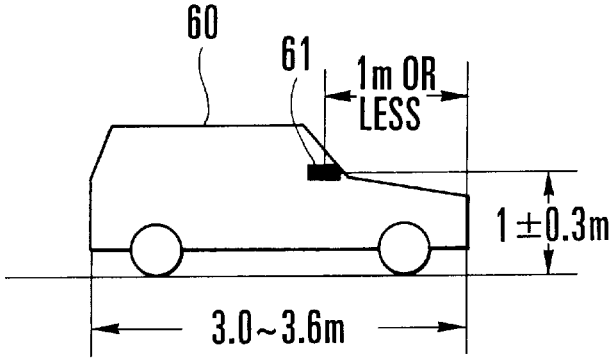
Figure 8C:
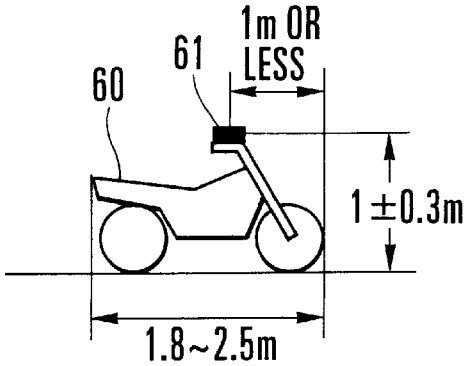

All vehicles capable of passing on the ETC lane 6 are classified in accordance with the shape and dimension and modeled under the most critical condition. FIGS. 8A to 8C show the shapes and dimensions of modeled vehicles.

The reference value L for discriminating a long vehicle from a short vehicle is set to be 3.6 m. This is because for vehicles made in Japan, the length of the longest nose of a vehicle largely changes when the vehicle length exceeds 3.6 m. As will be described later, the reference angle is defined using the length of the longest nose as a parameter. As the difference in the length of the longest nose between a long vehicle and a short vehicle becomes large, the difference in reference angle also increases.

When the reference value L is 3.6 m, the vehicle length determination section 12 shown in FIG. 1 classifies vehicles into long vehicles and short vehicles on the basis of whether the vehicle length is 3.6 m or more. In this embodiment, the reference value L is set to be 3.6 m. However, vehicles may be classified on the basis of a predetermined vehicle length depending on the design or operation condition or production country.

FIGS. 8A to 8C show the optimum values of the models of vehicles made in Japan. For a long vehicle, the vehicle length is 3.6 m or more, the length (longest nose) from the front end of the vehicle to the radio communication unit 61 is 2 m or less, and the setting height of the radio communication unit 61 is 1±0.3 m, as shown in FIG. 8A.

Short vehicles include four-wheeled vehicles and motorcycles. For a four-wheeled vehicle, the vehicle length is 3.0 to 3.6 m, the length (longest nose) from the front end of the vehicle to the radio communication unit 61 is 1 m or less, and the setting height of the radio communication unit 61 is 1±0.3 m, as shown in FIG. 8B. When the radio communication unit 61 is mounted on the front body, including the handlebar, of a motorcycle, the vehicle length is 1.8 to 2.5 m, the length from the front end of the vehicle to the radio communication unit 61 is 1 m or less, and the setting height of the radio communication unit 61 is 1±0.3 m, as shown in FIG. 8C.

Figure 9A:
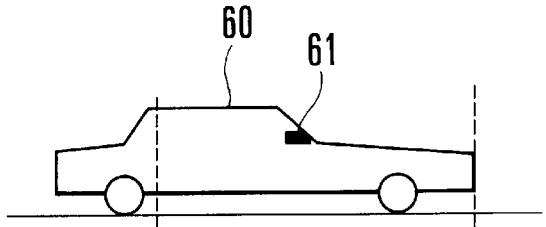
FIGS. 9A to 9C are views for explaining a method of setting the reference angle for a long vehicle.
Figure 9B:
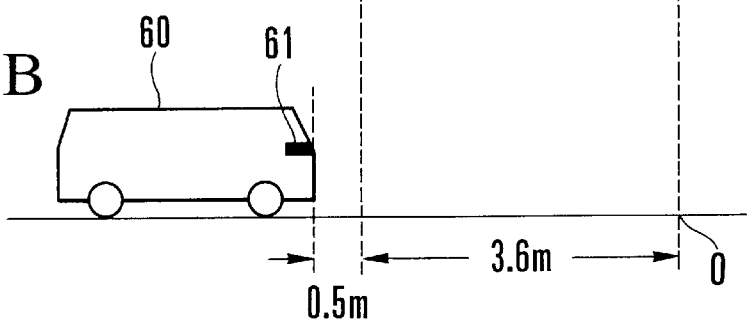
Figure 9C:
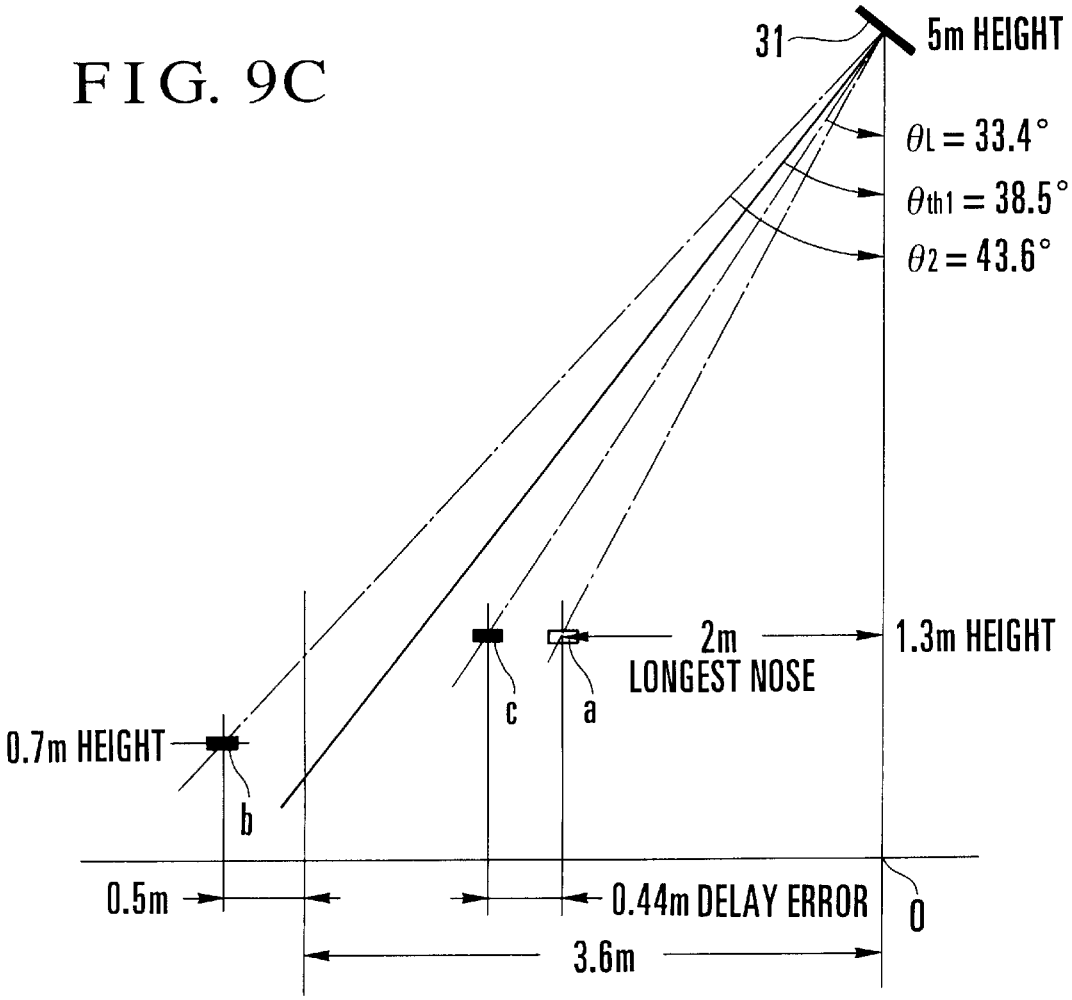

A method of setting a reference angle θth1 for determining a long vehicle will be described next. FIGS. 9A to 9C explain the method of setting the reference angle θth1 of a long vehicle.

FIG. 9A shows a state wherein the front end of a long vehicle as the ETC vehicle 60 running on the ETC lane 6 reaches the DF angle origin O. FIG. 9B shows the limit position of the ETC vehicle 60 following the long vehicle ahead.

Points a and b shown in FIG. 9C represent the positions of the radio communication units 61 of the ETC vehicles 60 shown in FIGS. 9A and 9B, respectively. A point c in FIG. 9C represents the position of the radio communication unit 61 obtained by considering the delay error for the point a.

This delay error is based on the delay in calculating the arrival angle of the radio wave and the time after the vehicle has reached the DF angle origin O until the arrival angle is read out, and is set to be 0.44 m.

In FIG. 9C, the longest nose of the long vehicle is modeled to 2 m. When the ETC vehicle 60 ahead is a long vehicle, the limit position in consideration of the delay error of the radio communication unit 61 of the ETC vehicle 60 ahead is set at a point separated from the DF angle origin O by 2.44 m horizontally and 1.3 m vertically.

The length of a long vehicle is 3.6 m or more. When the distance between the ETC vehicle 60 ahead and the subsequent ETC vehicle 60 is 0.5 m, and the ETC vehicle 60 ahead is a long vehicle, the limit position of the radio communication unit 61 of the subsequent ETC vehicle 60 is set at a point separated from the DF angle origin O by 4.1 m horizontally and 0.7 m vertically.

When the setting height of the DF antenna 31 is 5 m, a limit arrival angle θ1 of a radio wave transmitted from the limit position of the radio communication unit 61 of the ETC vehicle 60 ahead to the DF antenna 31 is 33.4°. A limit arrival angle θ2 of a radio wave transmitted from the limit position of the radio communication unit 61 of the subsequent ETC vehicle 60 is 43.6°. Therefore, the reference angle θth1 for the ETC vehicle 60 ahead as a long vehicle is the intermediate value between θ1 and θ2, i.e., 38.5°.

If the ETC vehicle 60 ahead is a high vehicle such as a truck with a large vehicle height, the arrival angle of the radio wave from the radio communication unit 61 of the ETC vehicle 60 is smaller than the limit arrival angle θ1. Therefore, the high vehicle is not critical for the vehicle identification operation of the ETC system shown in FIG. 1.

A method of setting a reference angle θth2 of a short vehicle will be described next. FIGS. 10A to 10C explain the method of setting the reference angle θth2 of a short vehicle.

FIG. 10A shows a state wherein the front end of a short vehicle as the ETC vehicle 60 running on the ETC lane 6 reaches the DF angle origin O. FIG. 10B shows the limit position of the ETC vehicle 60 following a motorcycle ahead.

Points e and f shown in FIG. 10C represent the positions of the radio communication units 61 of the ETC vehicles 60 shown in FIGS. 10A and 10B, respectively. A point g in FIG. 10C represents the position of the radio communication unit 61 obtained by considering the delay error for the point e.

In FIG. 10C, the delay error is set to be 0.44 m, as in the case wherein the vehicle ahead is a long vehicle shown in FIGS. 9A to 9C. When the longest nose of the ETC vehicle 60 as a short vehicle ahead is modeled to 1 m, the limit position in consideration of the delay error of the radio communication unit 61 of the ETC vehicle 60 ahead is set at a point separated from the DF angle origin O by 1.44 m horizontally and 1.3 m vertically.

The length of a motorcycle is 1.8 to 2.5 m. When the distance between the ETC vehicle 60 ahead and the subsequent ETC vehicle 60 is 0.5 m, and the ETC vehicle 60 ahead is a short vehicle, the limit position of the radio communication unit 61 of the subsequent ETC vehicle 60 is set at a point separated from the DF angle origin O by 2.3 m horizontally and 0.7 m vertically.

When the setting height of the DF antenna 31 is 5 m, the limit arrival angle θ1 of a radio wave transmitted from the limit position of the radio communication unit 61 of the ETC vehicle 60 ahead to the DF antenna 31 is 21.3°. The limit arrival angle θ2 of a radio wave transmitted from the limit position of the radio communication unit 61 of the subsequent ETC vehicle 60 is 28.1°. Therefore, the reference angle θth2 for the ETC vehicle 60 ahead as a short vehicle is the intermediate value between θ1 and θ2, i.e., 24.7°.

For both the long vehicle and the short vehicle, the reference angles θth1 and θth2 are set at the intermediate values between the limit arrival angles θ1 and θ2. However, the reference angles θth1 and θth2 can be set at any angles between the limit arrival angles θ1 and θ2 as far as they can be discriminated from the limit arrival angles θ1 and θ2 by the DF unit 3.

Figure 11:
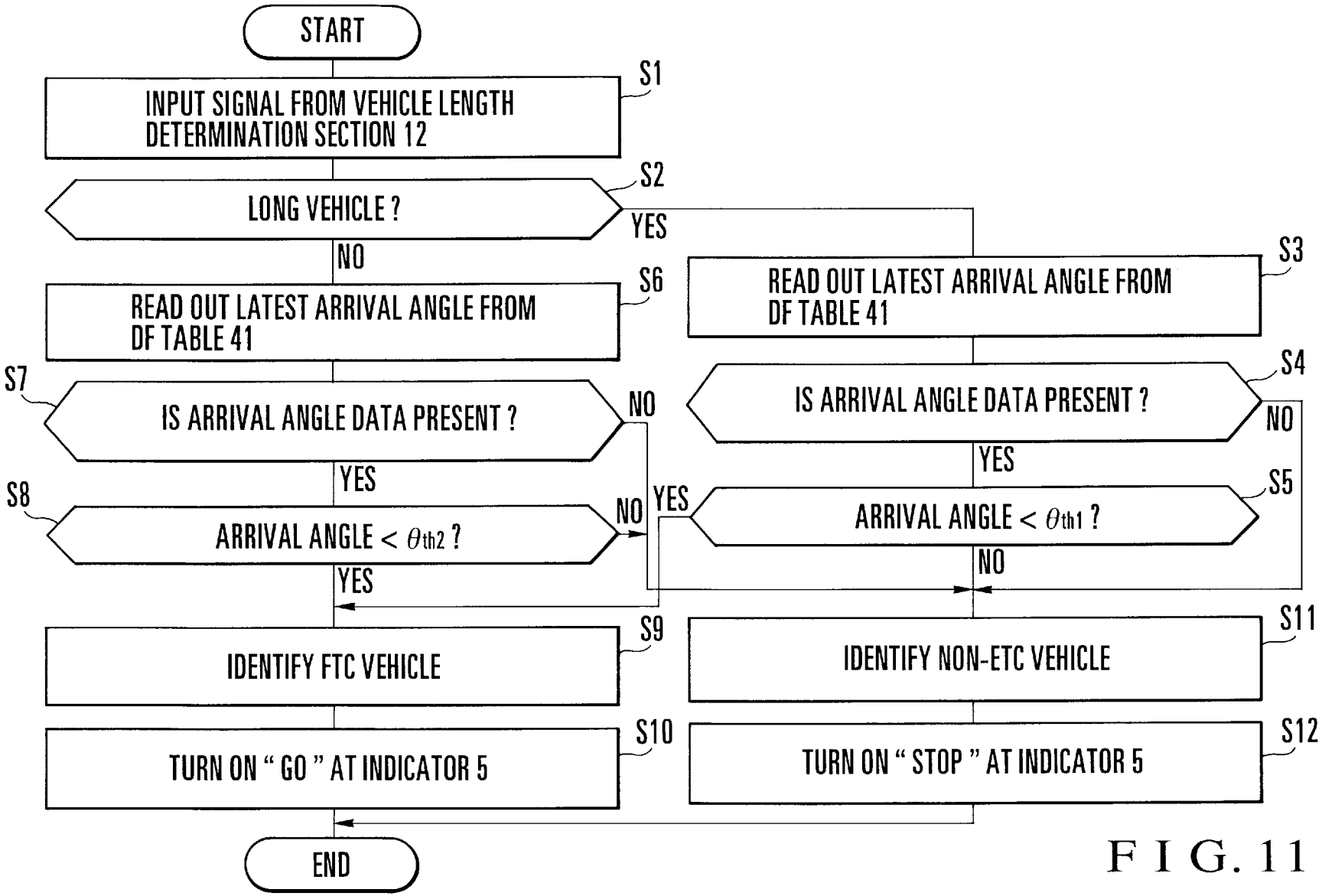
FIG. 11 is a flow chart showing the operation of a vehicle identification section shown in FIGS. 1 and 12.

The operation of the vehicle identification section 4 will be described next with reference to the flow chart of FIG. 11.

When the ETC vehicle 60 enters the communication enabled area B of the radio communication antenna 21, ETC communication is started between the radio communication unit 61 of the ETC vehicle 60 and the radio communication unit 2 of the gate 10. When ETC communication is established, the radio control section 22 outputs, to the vehicle identification section 4, the vehicle ID unique to the ETC vehicle 60, the communication establishment time, and the frame number and slot number for radio wave collation. The DF signal processing section 37 outputs the arrival angle of a radio wave transmitted from the ETC vehicle 60 to the vehicle identification section 4.

The vehicle identification section 4 stores the vehicle ID, the communication establishment time, the frame number, the slot number, which are output from the radio control section 22, and the arrival angle output from the DF signal processing section 37 in the DF table 41 (FIG. 13). Until the vehicle classification unit 1 detects that the ETC vehicle 60 has reached the DF angle origin O, the vehicle identification section 4 sequentially continues to update the data stored in the DF table 41 to new data output for every sampling period.

When it is detected that the front end of the vehicle running on the ETC lane 6 has reached the DF angle origin O, the vehicle length determination section 12 determines whether the vehicle is a long vehicle or a short vehicle, and outputs a signal representing the determination result to the vehicle identification section 4. When the output signal from the vehicle length determination section 12 is input to the vehicle identification section 4 (step S1), the vehicle identification section 4 determines whether the vehicle is a long vehicle, on the basis of the determination output from the vehicle length determination section 12 (step S2).

If YES in step S2, the latest DF radio wave arrival angle stored in the DF table 41 is read out (step S3). At this time, the storage state determination section 42 of the vehicle identification section 4 determines whether the arrival angle data is stored in the DF table 41 (step S4). If YES in step S4, the arrival angle determination section 43 compares the readout arrival angle data with the reference angle θth1 of the long vehicle (step S5).

If the vehicle determination section 44 of the vehicle identification section 4 determines that the arrival angle of the DF radio wave is smaller than the reference angle θth1, the vehicle identification section 4 determines that the radio wave is transmitted from the vehicle reaching the angle origin O and identifies the vehicle as the ETC vehicle 60 (step S9). If it is determined in step S5 that the arrival angle of the DF radio wave is larger than the reference angle θth1, the vehicle identification section 4 determines that the radio wave is not transmitted from the vehicle reaching the angle origin O and identifies the vehicle reaching the angle origin O as a non-ETC vehicle (step S11).

If NO in step S4, the vehicle identification section 4 determines that the vehicle reaching the angle origin O transmits no DF radio wave and identifies this vehicle as a non-ETC vehicle (step S11).

If it is determined in step S2 that the vehicle is a short vehicle, the vehicle identification section 4 reads out the latest DF radio wave arrival angle stored in the DF table 41

(step S6). When the storage state determination section 42 of the vehicle identification section 4 determines that the arrival angle data is stored in the DF table 41 (step S7), the arrival angle determination section 43 compares the reference angle θth2 of the short vehicle with the readout arrival angle (step S8).

If the arrival angle of the DF radio wave is smaller than the reference angle θth2, the vehicle determination section 44 of the vehicle identification section 4 identifies the vehicle reaching the angle origin O as the ETC vehicle 60 (step S9). On the other hand, if the arrival angle is larger than the reference angle θth2, the vehicle is identified as a non-ETC vehicle (step S11).

If it is determined in step S7 that no arrival angle data is stored in the DF table 41, the vehicle identification section 4 identifies the vehicle reaching the angle origin O as a non-ETC vehicle (step S11).

When the vehicle is identified as the ETC vehicle 60 in step S9, the vehicle identification section 4 turns on "go" at the indicator 5 to allow the ETC vehicle 60 to pass (step S10). When the vehicle is identified as a non-ETC vehicle in step S11, ETC is not performed between the non-ETC vehicle and the gate 10, and the vehicle identification section 4 turns on "stop" at the indicator 5 to stop the non-ETC vehicle (step S12).

The above embodiment has been described on the assumption that the radio communication unit 61 is mounted on the dashboard of the ETC vehicle 60 (in a motorcycle, on the front body including the handlebar). However, the present invention can be applied even when the radio communication unit 61 is mounted on another place where communication can be performed. In this case as well, the reference angles θth1 and θth2 for specifying the ETC vehicle 60 are set on the basis of the place where the radio communication unit 61 is mounted.

In this embodiment, vehicles are classified into two types on the basis of one reference value L, and the reference angles θth1 and θth2 are set in advance for the two types. However, the vehicle lengths may be classified into three ore more types by setting a plurality of reference values L, and three or more reference angles θth may be set accordingly.

In the above embodiment, the present invention is applied to the ETC system used in a toll road. However, the application field of the present invention is not limited to this. For example, the present invention can be applied to automatically collect a toll by radio communication at the entrance gate or exit gate of a toll parking lot or the like. The present invention is also effective to specify a vehicle compatible with the system from a plurality of vehicles continuously approaching the gate of a predetermined equipment without collecting the toll.

As has been described above, according to the present invention, approaching vehicles are classified by the vehicle length determination means on the basis of the vehicle length, the arrival angle of a radio wave is measured by the directional finding means, and the vehicle identification means determines whether the arrival angle of the radio wave when the approaching vehicle has reached a predetermined position falls within a predetermined range set for each type of vehicle. With this arrangement, even when the distance between a plurality of vehicles is short, a vehicle compatible with the system can be specified from the plurality of vehicles.

In addition, the directional finding means time-divisionally measures the arrival angle of the radio signal transmitted from the radio communication means mounted on the vehicle. Therefore, even when a plurality of vehicles compatible with the system are simultaneously present in the communication area of the radio communication means set at the gate, it can be appropriately determined whether each vehicle is a vehicle compatible with the system.

What is claimed is:

1. A radio-communication vehicle identification apparatus comprising:

first radio communication means mounted on a vehicle;

second radio communication means placed at a gate through which the vehicle passes to perform radio communication with said first radio communication means;

directional finding means for measuring an arrival angle of a radio signal transmitted from said first radio communication means with respect to a reference direction;

vehicle classification means for detecting a length of the vehicle on the basis of image data obtained by photographing the vehicle and classifying the vehicle on the basis of a detection result; and vehicle identification means for, when the vehicle has reached a predetermined position on the gate, determining whether the arrival angle output from said directional finding means falls within an arrival angle range of the radio signal from said first radio communication means, which corresponds to vehicle classification data output from said vehicle classification means, and identifying the vehicle having said first radio communication means on the basis of a determination result.

2. An apparatus according to claim 1, wherein said vehicle classification means comprises image sensing means for photographing the vehicle and outputting the image data, and vehicle length determination means for detecting the length of the vehicle on the basis of the image data from said image sensing means, classifying the vehicle on the basis of the detected vehicle length, and outputting the vehicle classification data.

3. An apparatus according to claim 1, wherein when a plurality of vehicles are present in a communication area where radio communication can be performed, said second radio communication means time-divisionally assigns a radio signal transmission time to said first radio communication means of each of the plurality of vehicles, and said directional finding means time-divisionally measures the arrival angle of the radio signal transmitted from said first radio communication means.

4. An apparatus according to claim 1, wherein the arrival angle range of the radio wave is set between the arrival angle of a radio wave transmitted from said first radio communication means of a vehicle belonging to a first classification and reaching the predetermined position and the arrival angle of a radio wave transmitted from said first radio communication means of a vehicle following the vehicle belonging to the first classification and reaching the predetermined position.

5. A radio-communication vehicle identification apparatus comprising:

first radio communication means mounted on a vehicle;

second radio communication means placed at a gate through which the vehicle passes to perform radio communication with said first radio communication means;

directional finding means for measuring an arrival angle of a radio signal transmitted from said first radio communication means with respect to a reference direction;

vehicle classification means for detecting a length of the vehicle on the basis of image data obtained by photographing the vehicle and classifying the vehicle on the basis of a detection result; and vehicle identification means for, when the vehicle has reached a predetermined position on the gate, determining whether the arrival angle output from said directional finding means falls within an arrival angle range of the radio signal from said first radio communication means, which corresponds to vehicle classification data output from said vehicle classification means, and identifying the vehicle having said first radio communication means on the basis of a determination result;

wherein said vehicle identification means comprises:

first determination means for, when the vehicle has reached the predetermined position on the gate, determining whether the arrival angle is output from said directional finding means;

second determination means for obtaining one of a plurality of arrival angle ranges of the radio signal from said first radio communication means, which are set in advance, in accordance with the vehicle classification data from said vehicle classification means, and determining whether the arrival angle output from said directional finding means falls within the obtained arrival angle range; and third determination means for determining, on the basis of determination results from said first and second determination means, whether the vehicle reaching the predetermined position is the vehicle having the first radio communication means.

6. A radio-communication vehicle identification apparatus comprising:

first radio communication means mounted on a vehicle;

second radio communication means placed at a gate through which the vehicle passes to perform radio communication with said first radio communication means;

directional finding means for measuring an arrival angle of a radio signal transmitted from said first radio communication means with respect to a reference direction;

vehicle classification means for detecting a length of the vehicle on the basis of image data obtained by photographing the vehicle and classifying the vehicle on the basis of a detection result;

vehicle identification means for, when the vehicle has reached a predetermined position on the gate, determining whether the arrival angle output from said directional finding means falls within an arrival angle range of the radio signal from said first radio communication means, which corresponds to vehicle classification data output from said vehicle classification means, and identifying the vehicle having said first radio communication means on the basis of a determination result; and detection means for detecting that the vehicle has reached the predetermined position on the gate, and wherein the predetermined position is set at a position where said directional finding means can detect the arrival angle of the radio signal from said first radio communication means.

7. An apparatus according to claim 2, wherein said vehicle length determination means classifies the vehicle on the basis of whether or not the length of the vehicle is larger than a reference value.

8. A radio-communication vehicle identification apparatus comprising:

a first radio communication device mounted on a vehicle;

a second radio communication device placed at a location through which the vehicle passes, for performing radio communication with said first radio communication device;

a directional finder for measuring an arrival angle of a radio signal transmitted from said first radio communication device with respect to a reference direction;

a vehicle classification device for classifying on the basis of image data obtained by photographing the vehicle;

a vehicle length detector for detecting the length of the vehicle on the basis of the image data, classifying the vehicle on the basis of the detected vehicle length, and outputting the vehicle classification data; and a vehicle identifier for when the vehicle has reached a predetermined position, determining whether the arrival angle output from said directional finder falls within an arrival angle range of the radio signal from said first radio communication device, which corresponds to vehicle classification data output from said vehicle classification device, and identifying the vehicle having said first radio communication device on the basis of a determination result.

9. An apparatus according to claim 8, wherein said vehicle identifier comprises:

a first determiner for, when the vehicle has reached the predetermined position, determining whether the arrival angle is output from said directional finder.

10. An apparatus according to claim 9, wherein said vehicle identifier comprises:

a second determiner for obtaining one of a plurality of arrival angle ranges of the radio signal from said first radio communication device, which are set in advance, in accordance with the vehicle classification data from said vehicle classifier, and determining whether the arrival angle output from said directional finder falls within the obtained arrival angle range.

11. An apparatus according to claim 10, wherein said vehicle identifier comprises:

a third determiner for determining, on the basis of determination results from said first and second determiner, whether the vehicle reaching the predetermined position is the vehicle having the first radio communication device.

12. An apparatus according to claim 8, further comprising:

a detector for detecting that the vehicle has reached the predetermined position.

13. An apparatus according to claim 12, wherein the predetermined position is set at a position where said directional finder can detect the arrival angle of the radio signal from said first radio communication device.

14. An apparatus according to claim 8, wherein said vehicle length detector classifies the vehicle on the basis of whether or not the length of the vehicle is larger than a reference value.

15. An apparatus according to claim 8, wherein where a plurality of vehicles are present in a communication area where radio communication can be performed, said second radio communication device time-divisionally assigns a radio signal transmission time to said first radio communication device of each of the plurality of vehicles.

16. An apparatus according to claim 15, wherein said directional finder time-divisionally measures the arrival angle of the radio signal transmitted from said first radio communication device.

17. An apparatus according to claim 8, wherein the arrival angle range of the radio wave is set between the arrival angle of a radio wave transmitted from said first radio communication device of a vehicle belonging to a first classification and reaching the predetermined position and the arrival angle of a radio wave transmitted from said first radio communication device of a vehicle following the vehicle belonging to the first classification and reaching the predetermined position.

18. An apparatus according to claim 9, wherein the arrival angle range of the radio wave is set between the arrival angle of a radio wave transmitted from said first radio communication device of a vehicle belonging to a first classification and reaching the predetermined position and the arrival angle of a radio wave transmitted from said first radio communication device of a vehicle following the vehicle belonging to the first classification and reaching the predetermined position.

19. An apparatus according to claim 10, wherein the arrival angle range of the radio wave is set between the arrival angle of a radio wave transmitted from said first radio communication device of a vehicle belonging to a first classification and reaching the predetermined position and the arrival angle of a radio wave transmitted from said first radio communication device of a vehicle following the vehicle belonging to the first classification and reaching the predetermined position.

* * * * *